US005716262A

United States Patent [19]

Kiba

[11] Patent Number: 5,716,262

[45] Date of Patent: Feb. 10, 1998

[54] MARKING APPARATUS FOR MARKING PAINTED SURFACE

[75] Inventor: Hiroshi Kiba, Hiroshima-ken, Japan

[73] Assignee: Mazda Motor Corporation, Hiroshima, Japan

[21] Appl. No.: 327,662

[22] Filed: Oct. 21, 1994

[30] Foreign Application Priority Data

Oct. 21, 1993 [JP] Japan ..... 5-263562

[51] Int. Cl.[6] ..... B24B 31/00

[52] U.S. Cl. ..... 451/103; 451/190

[58] Field of Search ..... 451/456, 451, 451/532, 536, 278, 280, 66, 190, 466, 455, 344, 388, 103; 15/21.1, 53.1, 180, 320, 321

[56] References Cited

FOREIGN PATENT DOCUMENTS 58-64157 4/1983 Japan .
5-138088 6/1993 Japan .

*Primary Examiner*—James G. Smith
*Assistant Examiner*—Derris H. Banks
*Attorney, Agent, or Firm*—Martin Fleit, PA

[57] ABSTRACT

A marking apparatus for forming scratch marks on a painted surface, at positions in which paint defects are detected, includes a rotary brush assembly having a number of strings, each of which contains approximately 25 weight percent of abrasive grains, stuck in and secured to a rotary body so as to form a circular brush head. A pressing device presses the rotary brush assembly against the painted surface with a regulated thrust force so as to form a circular scratch mark on the painted surface at a predetermined level of visual distinguishability.

18 Claims, 4 Drawing Sheets

MARKING APPARATUS FOR MARKING PAINTED SURFACE

BACKGROUND OF THE INVENTION

1. Field of the Invention

The present invention relates to a marking apparatus for producing circular marks on a painted surface, such as a vehicle body surface, for visual inspection of the surface for paint defects.

2. Description of Related Art

Typically, painted work surfaces, such as vehicle body surfaces, are water-polished to remedy or obliterate paint defects. In automatic manufacturing lines, inspectors visually inspect work surfaces, which are transported by a conveyor, to find paint defects and provide data regarding positions and grades of paint defects for a controller of an automatic water-polishing apparatus or industrial robots. Such an automatic water-polishing system is known from, for instance, Japanese Unexamined Patent Publication No. 58-64517.

In conventional painted surface inspection, inspectors visually inspect work surfaces to find paint film defects and, in particular, positions and grades of these paint film defects. The inspectors then manually apply distinguishable marks on the paint film defects. Such visual inspection and manual marking reduces job efficiency and increases labor and costs.

Defect inspection robots, which find paint film defects and perceive positions and grades of these defects so as to avoid the marking of these defects, are effective to automate and simplify the finishing of product surfaces. Nevertheless, the omission of marking requires complementary visual inspection or forces inspectors to inspect if there is a great number of defects, beyond the capacity of the robot, or if the robot has developed trouble. Further, a great number of defects makes it difficult for the robot to complete a polishing job within a tact time of the system.

When marking paint film defects, it is necessary to provide visually distinguishable marks without making scratches on or damaging the painted surface.

SUMMARY OF THE INVENTION

It is an object of the present invention to provide a marking apparatus for marking painted surface defects on a painted subject work at a predetermined level of visual distinguishability.

It is another object of the present invention to provide a marking apparatus which can cope with a great number of painted surface defects beyond the capacity of a polishing robot for paint defect obliteration.

The above objects of the present invention are achieved by providing a marking apparatus, used in cooperation with a surface defect inspection apparatus and a polishing apparatus which polishes a painted surface so as to obliterate painted defects, for forming scratch marks on a painted surface in positions at which paint defects exist. The marking apparatus includes a rotary brush assembly including a number of strings stuck in and secured to a rotary body rotatable about an axis of rotation so as to form a circular brush head with a center on the axis of rotation. Each string, which is desirably made of nylon, contains approximately 25 weight percent of abrasive grains. The circular brush head is pressed down against the painted surface with a regulated thrust force so as to make a circular scratch mark on the painted surface while the rotary brush assembly rotates. The rotary brush assembly is located in positions found by the inspection apparatus. The speed of the rotary brush head is changed according to grades of paint defects which are defined by depth and area so that the circular brush head is widened under centrifugal force when the rotary brush assembly rotates.

With the marking apparatus of the present invention, while the rotary brush assembly continues to rotate, the nylon brush head widens more due to centrifugal force, increasing the diameter of a base circle of the cone-shaped nylon string brush head. The base circle diameter of the cone shaped nylon brush is variable depending upon the speed of rotation of the rotary brush assembly. Because the thrust force with which the circular brush head is pressed down against the painted surface is kept constant, the marking apparatus can form scratch marks at a predetermined sufficient level of visual distinguishability without damaging the painted surface.

If the number of paint defects is not less than a critical predetermined number, the polishing robot exchanges each of the marking apparatus and the polishing apparatus for the other in position and causes the marking apparatus to only form scratch marks on the excessive number of paint defects, over the critical number of paint defects. The marked excessive paint defects are visually recognized and polished later. Furthermore, if the polishing assembly is out of order, the marking apparatus marks all paint defects so as to let the marked paint defects be subjected to easy visual recognition. This assures transport of subject works within a desired tact time.

BRIEF DESCRIPTION OF THE DRAWINGS

The above and other objects and features of the present invention will be clearly understood from the following description of a preferred embodiment thereof when considered in conjunction with the accompanying drawings, in which.

DESCRIPTION OF THE PREFERRED EMBODIMENT

Figure 1:
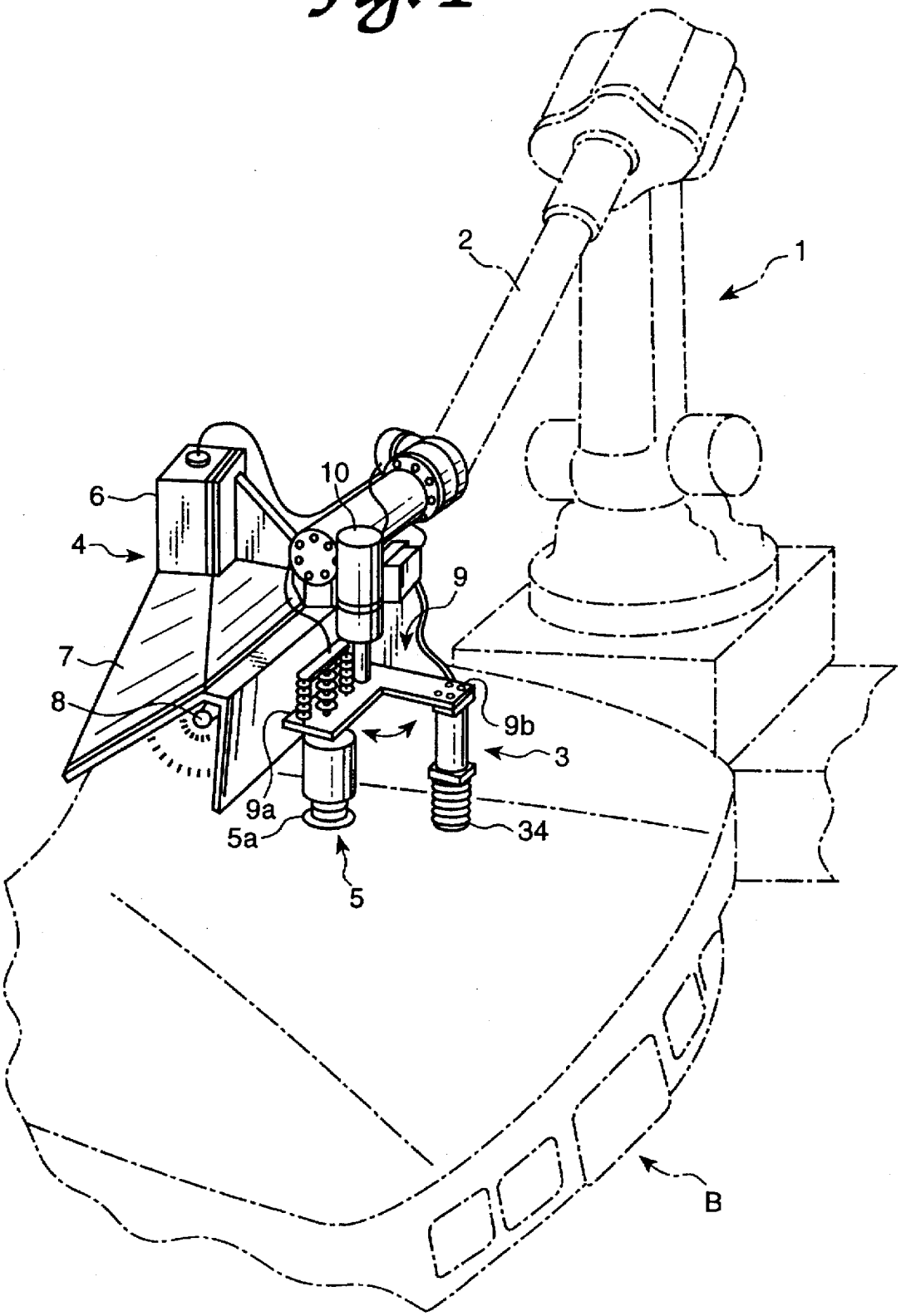
FIG. 1 is a perspective view of a paint defect polishing robot with a marking apparatus in accordance with a preferred embodiment of the present invention.

Referring now to the drawings in detail and, in particular, to FIG. 1, a marking apparatus in accordance with a preferred embodiment of the present invention is shown, which marking apparatus cooperates with a paint defect polishing robot 1. This paint defect polishing robot 1 has a robot arm 2 provided at its end with a surface inspection apparatus 4 directly secured thereto, and a marking head 3 and a polishing head 5 secured thereto through a generally L-shaped mounting bracket 9. Specifically, the polishing head 5 with a polishing tool 5*a*, for polishing the vehicle body surface to obliterate paint film defects, is attached to an arm 9*a* of the L-shaped mounting bracket 9. The marking head 3 is attached to another arm 9*b* of the L-shaped mounting bracket 9. The marking head 3 and polishing head 5 are positioned at an equal distance from the center axis of rotation of the motor 10. The robot arm 2 is further provided at the end with a reversible motor 10 with its center axis of rotation placed vertically. This motor turns the mounting bracket 9 in both directions through an angle of 90 degrees around the center axis of rotation of the motor 10.

Accordingly, there is caused a replacement in position of one of the marking head 3 and polishing head 5 with another through a rotation of the motor 10 through an angle of 90 degrees in one direction, and vise versa through a rotation of the motor 10 through an angle of 90 degrees in another direction. For instance, the paint defect polishing robot 1 shown in FIG. 1 has placed the marking head 3 in a working position and the polishing head 5 in a rest position. When the motor 10 makes a turn of 90 degrees counterclockwise as viewed in FIG. 1, the polishing head 5 takes the place of the marking head 3 in working position and, simultaneously, the marking head 3 is brought into its rest position. When the motor 10 turns back through an angle of 90 degrees in the clockwise direction, the polishing head 5 returns to the rest position and, simultaneously, the marking head 3 takes the place of the polishing head 5 in the working position.

The surface defect inspection apparatus 4 includes an image pick-up device, such as a charge coupled device (CCD) camera 6 and a light source 8 mounted within a lamp house, or housing 7. The CCD camera 6 forms an image of an illuminated surface of a subject work, such as a painted vehicle body B, on a charge coupled device.

Figure 2:
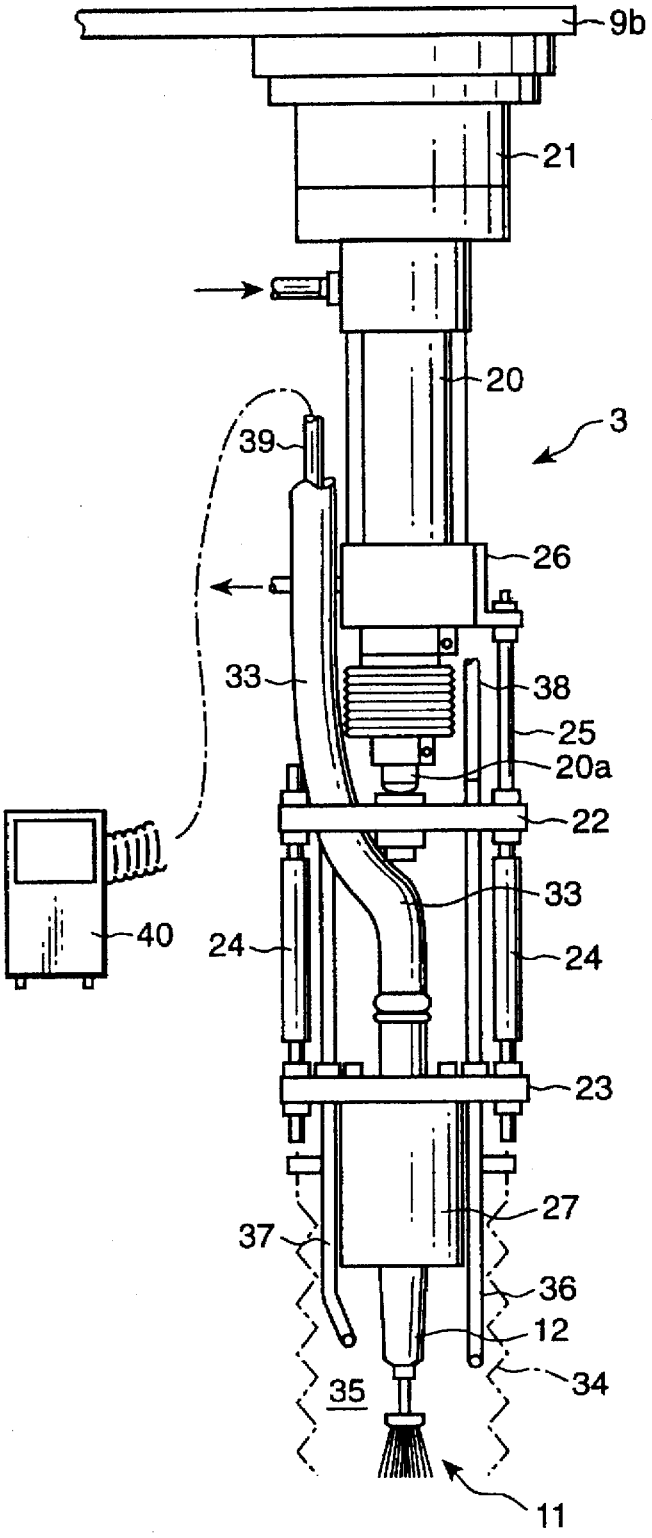
FIG. 2 is a front view of the marking apparatus.
Figure 3:
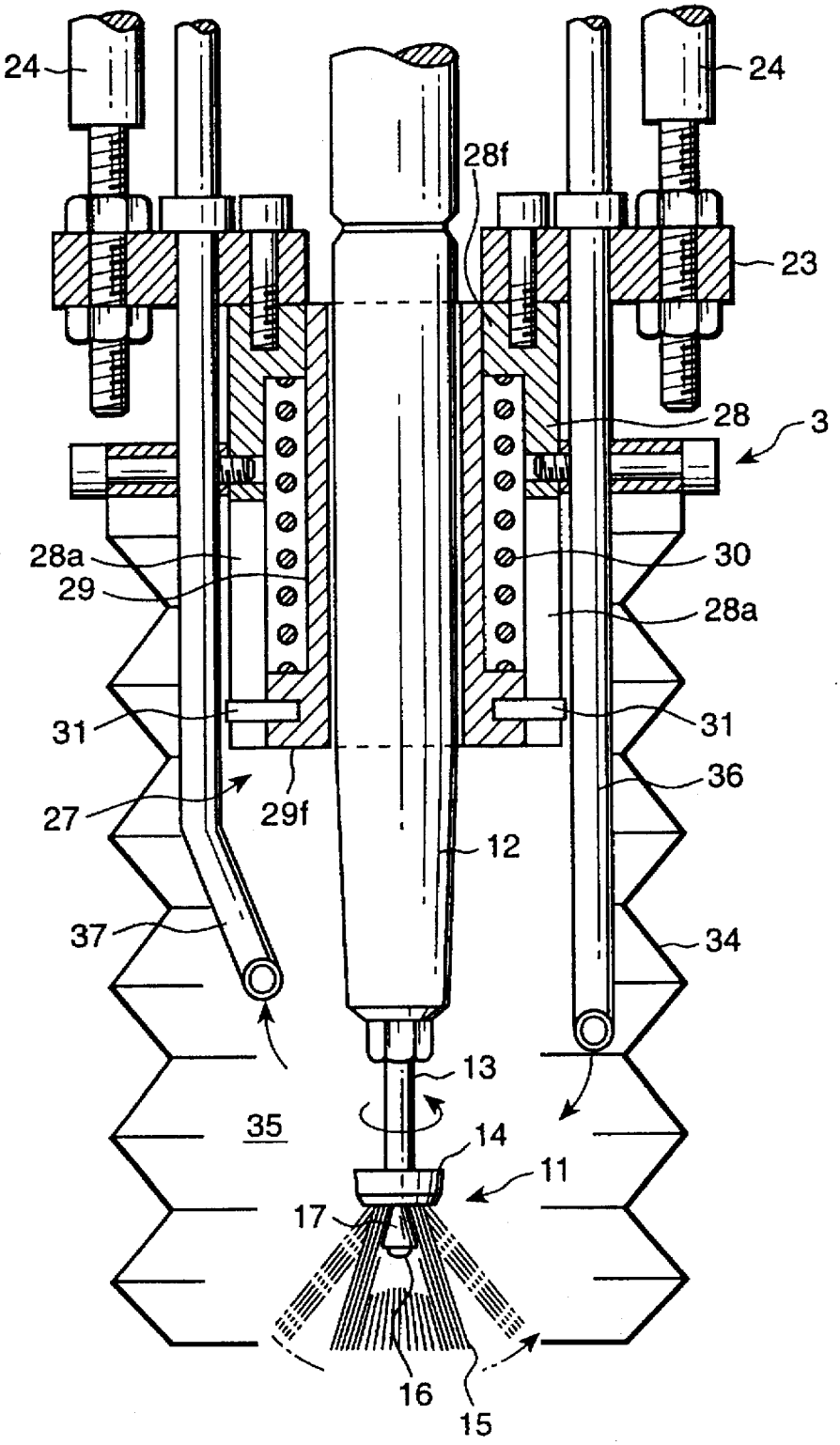
FIG. 3 is an enlarged front view showing, partly in cross-section, an essential part of the marking apparatus.

Referring to FIGS. 2 and 3, the marking head 3 is provided at its lower end with a rotary brush assembly 11. As seen in and understood from, in particular, FIG. 3, the rotary brush assembly 11 is comprised of a shank 13 formed at its lower end with an annular flange 14 as a rotary body. A great number of strings 15 or the like are stuck in and secured to the flange 14, and a conical block 17 is secured to the flange 14 with a screw 16. This brush assembly 11 is attached to the marking head 3 with the shank 14 chucked to a vertically elongated, cylindrical air turbine 12. Each string 15 is made of nylon containing approximately 25 weight percent of abrasive grains and has a diameter of approximately 0.6 to 1.0 mm and a length of approximately 30 mm. The nylon strings 15 are distributed within a circular area having a diameter of approximately 10 mm of the under surface of flange 14 surrounding a screw hole (not shown) into which the screw is fastened. After sticking the nylon strings 15 into the flange 14, the screw 16 is fastened into the screw hole to secure the conical block 17 to the flange 14. The brush assembly 11, thus formed, provides a nylon brush head 15 widening downward like a cone while it is in a state of rest.

Figure 4:
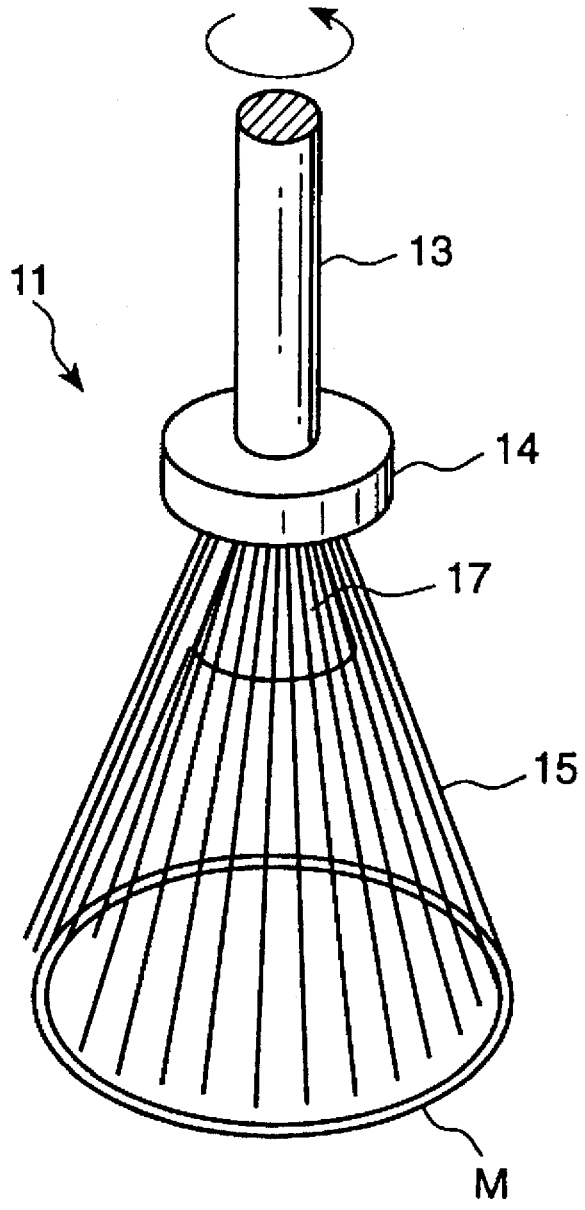
FIG. 4 is an illustration showing a nylon brush.

The brush assembly 11 attached to the marking head 3 is rotated by the air turbine 12. As shown in FIG. 4, while the brush assembly 11 continues to rotate, the nylon brush head 15 widens more due to centrifugal force, so as to increase the diameter of a base circle of the cone-shaped nylon string brush head 15. The base circle diameter of the cone shaped nylon brush head 15 depends upon the speed of rotation of the brush assembly 11. In this instance, when the brush assembly 11 rotates at a speed of approximately 1,500 rpm, the cone shaped nylon brush head 15 has a base circle diameter of approximately 30–50 mm. While the brush assembly 11 is rotating, the paint defect polishing robot 1 moves the marking head 3 downward so as to bring the nylon brush head 15 into contact with a painted surface of a subject work, forming a circular scratch mark having a diameter of approximately 30–50 mm.

As shown in detail in FIG. 2, the marking head 3 includes an air cylinder 20 for pressing the brush assembly 11 vertically downward against the painted surface of a subject work. This air cylinder 20 is attached to the arm **9*a* of the L-shaped mounting bracket 9 through a pressure control sensor 21. The air cylinder 20 is feedback controlled through the pressure control sensor 21 so as to develop a constant thrust force. An upper mounting plate 22, placed horizontally, is secured to the piston rod 20*a* of the air cylinder 20. On the other hand, a lower mounting plate 23 is attached to a cylindrical spring housing 27 supporting the air turbine 12 and placed in parallel with the upper mounting plate 22. These upper and lower mounting plates 22 and 23 are connected by a plurality of adjustable joints 24 to each other. Between the upper mounting plate 22 and an L-shaped bracket 26 secured to the air cylinder 20, a retainer rod 25 is provided such that it allows up and down movement of the upper and lower mounting plates 22 and 23 as a whole but prevents the upper and lower mounting plates 22 and 23 from turning as a whole about the center axis of the air cylinder 20**.

The spring housing 27 includes an outer cylindrical barrel 28 and an inner cylindrical barrel 29. The outer barrel 28 is integrally formed with an inner upper flange **28*f* to which the lower mounting plate 23 is directly bolted, or otherwise secured, and which receives the inner barrel 29 therein coaxially with the outer barrel 28 so as to allow it to slide up and down. The inner barrel 29, fixedly receiving the cylindrical air turbine 12 coaxially therein, is integrally formed with an outer lower flange 29*f* which is received coaxially within the outer barrel 28 so as to be allowed to slide up and down. As seen in FIG. 3, there is formed, between the inner and outer flanges 28*f* and 29*f*, an axial space. The spring housing 27, thus configured, receives, in the axial space, a coil spring 30 disposed between the inner and outer flanges 28*f* and 29*f*. This coil spring 30 functions so as to normally urge the inner barrel 29 downward with respect to the inner barrel 28 and to damp impact applied to the brush assembly 11 caused instantaneously when the brush assembly 11 is brought into contact with a subject work surface. The outer barrel 28 of the spring housing 27 is formed with a pair of external axial grooves 28*a* within which a pair of guide pins 31 extending radially from the inner barrel 29 are received, respectively, for sliding movement so as to prevent relative rotational movement between the inner and outer barrels 29 and 28. Since the air turbine 12 is secured in the inner barrel 29, it can move up and down together with the inner barrel 29**.

The air turbine 12 is supplied with air through a flexible air hose 33 extending from an air source (not shown) passing through the upper mounting plate 22. The major portion of the brush assembly 11 is covered by a bellows type of flexible dust cover 34 secured at its top to the outer barrel 28 of the spring housing 27. This flexible dust cover 34 is brought into close contact with a subject work surface and forms a substantially sealed space 35 around the brush assembly 11 when the nylon brush head 15 reaches the subject work surface. In order to clear the interior space 35, compressed air is delivered into the sealed space 35 through an air blow nozzle 36 via an air hose 38 and dust blown off within the space 35 is collected through a suction nozzle 37 and sucked out by a dust arrester 40 through a suction hose 39.

In operation of the paint defect polishing robot 1 provided with the marking head 3 of the present invention as well as the surface inspection apparatus 4 and the polishing head 5, the polishing robot 1 starts inspection and obliteration of paint defects. The motor 10 is caused to turn the mounting bracket 9 through 90 degrees in the counterclockwise direction so as to place the polishing head 5 in the working position and the marking head 3 in the rest position. Then, the surface inspection apparatus 4 picks up an image of a circular unit area having a diameter of, for instance, approximately 50 mm of the painted surface and processes data representative of the image so as to find paint defects, grades and positions in X-Y perpendicular co-ordinates. Based on position data of these paint defects, the polishing robot 1 operates the robot arm 2 such that the polishing head 5 polishes the paint defects, one after another, so as to obliterate the paint defects.

The grade is defined by a depth and an area of a paint defect and becomes higher as the paint defect becomes deeper and/or wider. The polishing robot 1 increases a speed at which the air turbine 12 rotates as the grade of a paint defects becomes higher.

In this instance, if the number N of paint defects found in the circular unit area of the painted surface is less than a maximum number $N_{MAX}$ critical for the polishing head 5 to complete polishing all of the paint defects in the system tact time, while the polishing robot 1 actuates the polishing head 5 to polish all of the number N of paint defects, one after another, according to the positions and grades of these paint defects, it does not actuate the marking head 3. However, if the number N of paint defects in the circular unit area is not less than the critical number $N_{MAX}$, then the polishing robot 1 causes the motor 10 to turn the mounting bracket 9 through 90 degrees in the clockwise direction so as to place the polishing head 5 in the rest position and the marking head 3 in the working position and, thereafter, actuates the marking head 5 to make scratch marks on an excessive number of paint defects, excluding the critical number $N_{MAX}$ of paint defects, one after another, according to the positions of these excessive paint defects. For instance, if the critical number $N_{MAX}$ is ten (10), and twelve paint defects are found, only two paint defects are marked by the marking head 5. After having marked these defects, the polishing robot 1 causes the motor 10 to again turn back the mounting bracket 9 through 90 degrees in the counterclockwise direction so as to place the polishing head 5 and the marking head 3 in their previous positions. Then, the polishing robot 1 actuates the polishing head 5 to polish the critical number $N_{MAX}$ of paint defects, which have not been marked, one after another according to the position and grade data of the paint defects. The marked paint defects are visually recognized and polished later.

If, in the worst case, the polishing head 5 is out of order, the marking head 3 marks all of the paint defects found by the surface inspection apparatus 4 so as to let the marked paint defects be subjected to easy visual recognition.

As is apparent from the above description, since the paint defect polishing robot 1 exchanges each of the positions of the marking head 3 and the polishing head 5 for the other, it is sure to transport subject works with a desired tact time.

It is to be understood that although the present invention has been described with regard to preferred embodiments thereof, various other embodiments and variants may occur to those skilled in the art which are within the scope and spirit of the invention. Such other embodiments and variants are intended to be covered by the following claims.

What is claimed is:

1. A paint defect repairing apparatus having a surface inspection apparatus for detecting positions and grades of paint defects of a painted surface and a marking apparatus for marking paint defects of a painted surface comprising:

a rotary brush assembly comprising a rotary body rotatable about an axis of rotation and a number of strings, each of which contains abrasive grains, stuck in and secured to said rotary body so as to form a circular brush head with a center on said axis of rotation;

a drive motor for rotating said rotary brush assembly;

a pressing device for applying thrust force to and pressing down said brush head against the painted surface so as to make a circular scratch mark on a paint defect of the painted surface while said rotary brush assembly rotates; and control means for placing said rotary brush assembly at a position of a specific paint defect, causing said drive motor to rotate said rotary brush assembly at a speed of rotation set up so as to provide said circular brush head with a diameter varied according to a grade of said specified paint defect, and causing said pressing device to press down said brush head against the painted surface to put a circular scratch mark on said painted surface at said position.

2. A marking apparatus as defined in claim 1, wherein each of said strings is made of nylon containing approximately 25 weight percent of said abrasive grains.

3. A marking apparatus as defined in claim 1, wherein said rotary brush assembly further comprises a conical block secured to said rotary body so as to widen said circular brush head downward like a cone while said rotary brush assembly is in a state of rest.

4. A marking apparatus as defined in claim 1, wherein said strings are flexible so that said circular brush head is widened by centrifugal force when said rotary brush assembly rotates.

5. A marking apparatus as defined in claim 1, wherein said pressing device includes regulation means for regulating said thrust force.

6. A marking apparatus as defined in claim 1, and further comprising a bellows type flexible dust cover which is brought into contact with said painted surface so as to form a substantially sealed space around said rotary brush assembly when said circular brush head is pressed down against said painted surface.

7. A marking apparatus as defined in claim 6, and further comprising air blow means for providing an air blow in said sealed space.

8. A marking apparatus as defined in claim 7, and further comprising air suction means for sucking out and removing dust from within said sealed space.

9. A marking apparatus as defined in claim 1, wherein said control means controls a speed at which said drive motor rotates to change according to said grades of said paint defects.

10. A marking apparatus as defined in claim 9, wherein said control means controls said speed to increase as a grade, defined by a depth and an area of each paint defect, becomes higher.

11. A paint defect repairing apparatus as defined in claim 1, wherein said marking apparatus and said polishing apparatus are installed to and operated by one robot.

12. A painted surface repairing apparatus having a surface inspection apparatus for detecting positions and grades of paint defects of a painted surface, a marking apparatus for putting a mark on each of said paint defects detected by said surface inspection apparatus and a polishing apparatus for polishing each marked paint defect of the painted surface so as to repair each of the paint defects, said marking apparatus comprising:

a rotary brush assembly comprising a rotary body rotatable about said axis of rotation and a number of strings, each of which contains abrasive grains, stuck in and secured to said rotary body so as to form a circular brush head with a center on said axis of rotation;

a control means for placing said rotary brush assembly in each said position detected by said surface inspection apparatus;

a drive motor for rotating said rotary brush assembly; and a pressing device for applying thrust force to and pressing down said brush head against the painted surface so as to make a circular scratch mark on the painted surface while said rotary brush assembly rotates;

said control means replacing said marking apparatus with said polishing apparatus and causing said polishing apparatus to polish said paint defects marked by circular scratch marks;

wherein said marking apparatus and said polishing apparatus are installed to and operated by one robot.

13. A paint defect repairing apparatus having a surface inspection apparatus for detecting positions and grades of paint defects of a painted surface, a marking apparatus for marking said paint defects detected by said surface inspection apparatus, and a polishing apparatus for polishing said paint defects detected by said surface inspection apparatus, said marking apparatus comprising:

marking means having a circular brush rotatable about an axis of rotation; and control means for placing said marking means at a position of a specific paint defect, rotating said marking means about said axis of rotation at a speed of rotation set up so as to provide said circular brush with a diameter varied according to a grade of said specific paint defect, and pressing down said marking means against said painted surface to put a circular scratch mark on said painted surface at said position.

14. A paint defect repairing apparatus as defined in claim 13, wherein said control means replaces said polishing apparatus with said marking apparatus after said polishing apparatus has polished a predetermined number of paint defects detected by said surface inspection apparatus.

15. A paint defect repairing apparatus as defined in claim 13, wherein said surface inspection apparatus detects a grade of a paint defect from its depth and area.

16. A paint defect repairing apparatus as defined in claim 13, wherein said control means controls said speed of rotation of said marking means so that it increases as grades of said paint defects increase.

17. A paint defect repairing apparatus as defined in claim 13, wherein said circular brush comprises an annular bundle of a number of flexible strings which is expandable in diameter with centrifugal force while rotating.

18. A paint defect repairing apparatus as defined in claim 17, wherein each said flexible string contains abrasive grains.

* * * * *